US006237160B1

(12) United States Patent
Bouville

(10) Patent No.: US 6,237,160 B1
(45) Date of Patent: May 29, 2001

(54) TROUSERS BELT FOR A COOK

(76) Inventor: Thierry Bouville, 21, Rue Barla, 06300, Nice (FR)

( * ) Notice: Subject to any disclaimer, the term of this patent is extended or adjusted under 35 U.S.C. 154(b) by 0 days.

(21) Appl. No.: 09/274,956

(22) Filed: Mar. 23, 1999

(30) Foreign Application Priority Data

Apr. 1, 1998 (FR) ..... 9804027

(51) Int. Cl.[7] ..... A41F 9/00
(52) U.S. Cl. ..... 2/311
(58) Field of Search ..... 2/311, 321, DIG. 11, 2/920, 919, 170, 171.2, 181, 917, 338, 319, 312, 316

(56) References Cited

U.S. PATENT DOCUMENTS

| | | | | |
|---|---|---|---|---|
| 2,059,103 | | 10/1936 | Hardie et al. | 2/237 |
| 2,160,368 | * | 5/1939 | Monesson . | |
| 2,237,022 | * | 4/1941 | Andrews . | |
| 3,769,144 | * | 10/1973 | Economy et al. | 161/50 |
| 4,061,256 | * | 12/1977 | Beer et al. | 224/5 |
| 4,068,318 | * | 1/1978 | McMahon | 2/170 |
| 4,326,533 | * | 4/1982 | Henderson | 128/402 |
| 4,501,028 | * | 2/1985 | Gottschall | 2/338 |
| 4,502,156 | * | 3/1985 | Wishman | 2/181 |
| 4,513,047 | * | 4/1985 | Leach et al. | 428/175 |
| 4,539,982 | * | 9/1985 | Bailly | 128/156 |
| 4,627,109 | * | 12/1986 | Carabelli et al. | 2/44 |
| 4,829,604 | * | 5/1989 | Allen et al. | 2/170 |
| 4,843,653 | * | 7/1989 | Coble | 2/170 |
| 4,847,919 | * | 7/1989 | Hwang et al. | 2/338 |
| 4,854,319 | * | 8/1989 | Tobin | 128/380 |
| 4,856,116 | * | 8/1989 | Sullivan | 2/181 |
| 4,896,378 | * | 1/1990 | Campana | 2/170 |
| 4,958,385 | * | 9/1990 | Rushton, Jr. | 2/174 |
| 4,991,234 | * | 2/1991 | Greenberg | 2/170 |
| 4,999,853 | * | 3/1991 | Tanner | 2/321 |
| 5,016,291 | * | 5/1991 | Capper | 2/312 |
| 5,033,122 | * | 7/1991 | Smith | 2/209.3 |
| 5,086,758 | * | 2/1992 | Schiek, Sr., et al. | 602/19 |
| 5,141,141 | * | 8/1992 | Leone | 224/222 |
| 5,146,630 | * | 9/1992 | Richard | 2/181 |
| 5,150,475 | * | 9/1992 | Hansen et al. | 2/16 |
| 5,165,113 | * | 11/1992 | Hyams et al. | 2/268 |
| 5,209,801 | * | 5/1993 | Smith | 156/161 |
| 5,309,575 | * | 5/1994 | Lookhoof | 2/322 |
| 5,329,638 | * | 7/1994 | Hansen et al. | 2/16 |
| 5,386,593 | * | 2/1995 | Kleinman . | |
| 5,423,091 | * | 6/1995 | Lange | 2/181 |
| 5,539,933 | * | 7/1996 | Garber et al. | 2/311 |
| 5,692,380 | * | 12/1997 | Cox et al. | 62/56 |
| 5,845,654 | * | 12/1998 | Johnson | 132/210 |
| 5,867,836 | * | 2/1999 | Quinones . | |
| 5,973,221 | * | 10/1999 | Collyer et al. | 602/46 |

FOREIGN PATENT DOCUMENTS

| | | |
|---|---|---|
| 1 374 231 | 8/1964 | (FR) . |
| 776 719 | 6/1957 | (GB) . |

* cited by examiner

*Primary Examiner*—John J. Calvert
*Assistant Examiner*—Alissa L. Hoey
(74) *Attorney, Agent, or Firm*—Young & Thompson

(57) ABSTRACT

Trousers belt (20) for a cook who works near heat sources, comprising one or several materials that make it stretchy and capable of absorbing the user's sweat for several hours. It is made up of either a stretchy and absorbent material, or a first stretchy part (22) inserted into a second sleeve-shaped part (24) made of a sweat absorbent material. The belt further comprises a self-fixing fastening made up of a soft part (28) located on the outer face of a belt end (26) and a prickly part (34) located on the inner face of the other belt end (30).

6 Claims, 1 Drawing Sheet

TROUSERS BELT FOR A COOK

FIELD OF THE INVENTION

The present invention relates to trousers built-in belts and especially to a trousers belt for a cook who has to stay close to ovens and stoves for long periods.

BACKGROUND OF THE INVENTION

As everyone can imagine, a cook has a very physical activity. Therefore, he expects an absolute comfort of his (her) work clothes. Many improvements were made for the cook's jacket in order to lighten fabrics or get ampler shapes. Unfortunately, nothing was done to improve the cook's trousers.

And yet, the cook is subjected to high—sometime very high—temperatures in front of stoves, which, added to the intense physical activity, especially at the time of serving, causes the cook to sweat a lot. Therefore, the cook is subjected to large weight fluctuations. That way, at the peak of the season, a cook who sometimes works up to 12 or 14 hours a day in difficult conditions may lose a lot of weight, while, off season, he may put on weight. Moreover, weight fluctuations, certainly with a lower amplitude, may occur over shorter periods, e.g. 24 or 48 hours.

SUMMARY OF THE INVENTION

This is why the purpose of the invention is to provide a trousers belt for a cook that provides a real comfort to the latter, in spite of sweat and weight fluctuations he may be subjected to.

The object of the invention is thus a trousers belt for a cook working close to heat sources, comprising one or several materials that make it stretchy and capable of absorbing the user's sweat for several hours.

According to a first embodiment of the invention, the belt is made of only one stretchy and absorbent material.

According to a second embodiment of the invention, the belt comprises a stretchy part inserted into a second sleeve-shaped part made of an absorbent material.

BRIEF DESCRIPTION OF THE DRAWINGS

The purpose, object and features of the invention will become more apparent from the following detailed description with reference to the accompanying drawings in which.

DETAILED DESCRIPTION OF THE PREFERRED EMBODIMENTS

Figure 1:
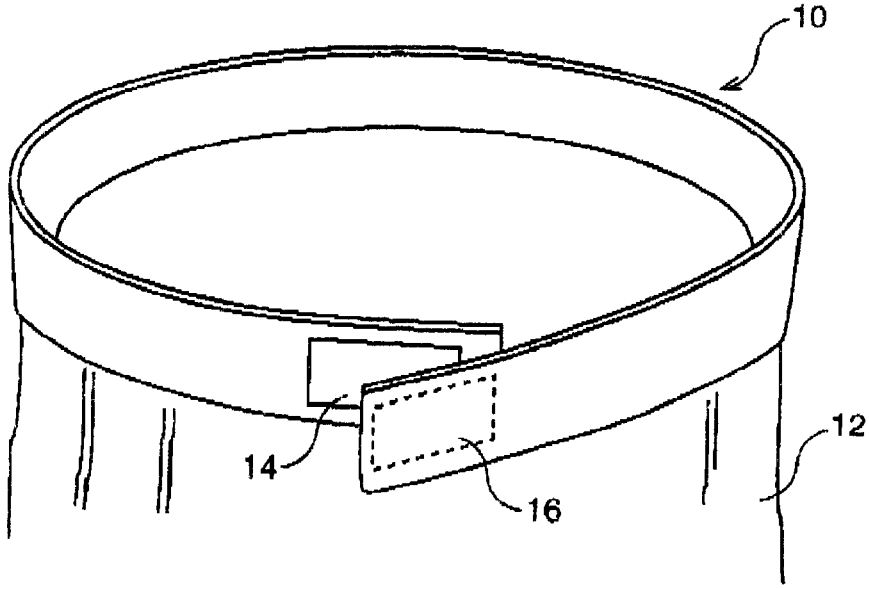
FIG. 1 shows schematically a trousers belt according to the invention made of a stretchy and absorbent material.
Figure 2:
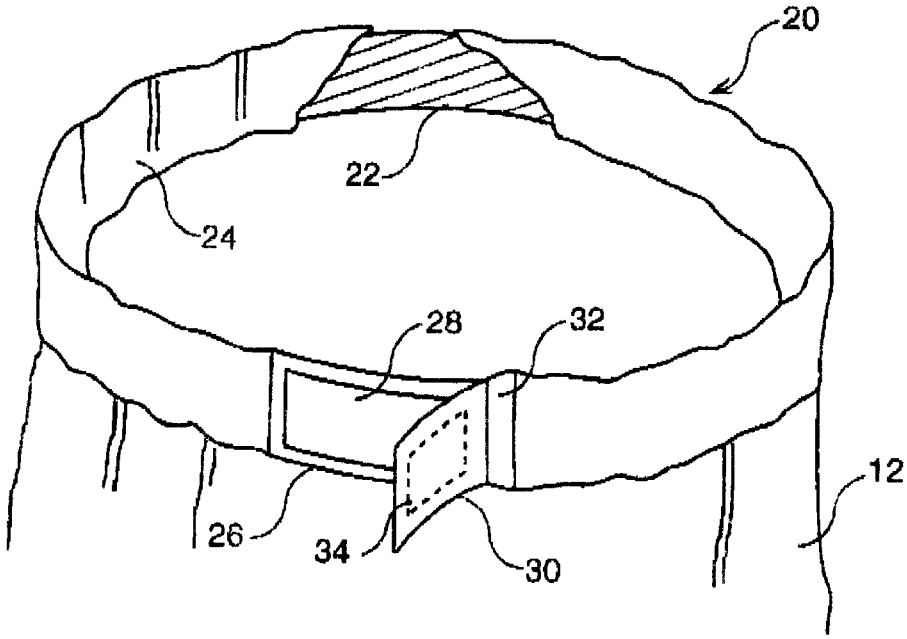
FIG. 2 shows schematically a trousers belt according to the invention comprising a stretchy part that is inserted into a sleeve made of a sweat absorbing material.

According to a first embodiment represented at FIG. 1, the belt 10 according to the invention, having a width of about 5 cm, is made of a single material. Such a material has two features: it is stretchy, which means that the belt adapts itself to the variable waist of the cook subjected to weight variations, and it is absorbent too, for absorbing the cook's sweat during periods, that may be as long as 12 hours in a row, spent in front of kitchen ovens and stoves. Such a material could be for example a sponge-like polymer foam such as polyurethane or neoprene foam. Of course, such a material must also be heat-resistant and non irritant for the skin. The belt, made interdependent with the trousers 12, includes a fastening means located in the front, preferably a Velcro® type self-fixing fastening made up of two components. The first component 14 is a rectangle that makes up the soft part, or astrakhan, about 5 to 10 cm long, fixed on the outer face of the belt end 10, and the second component 16 is a rectangle that makes up the prickly part, or hook, fixed on the inner face of the other belt end and having a length of about 5 cm. Moreover, such a self-fixing fastening enables to adjust the waist by applying the prickly part in front of or behind the soft part.

In a second embodiment of the invention, the belt 20 fixed to the trousers 12 is made up of two parts. An inner stretchy part 22, with a width of about 5 cm, is located inside an outer absorbent part 24 that forms a sleeve or a tunnel for the stretchy part 22.

The stretchy part 22 may be made of any elastomer material such as rubber, neoprene, . . . The absorbent part 24 must be made of a fabric capable of soaking damp in the manner of a towel or a terry-towelling, in order to absorb the cook's sweat without irritating his (her) skin, for periods of several hours the cook spends in the kitchen. In all cases, the material the sleeve 24 is made of must be heat-resistant and, if possible, flameproof.

The end of the inner stretchy part 22 is attached to a portion 26 of the sleeve 24 provided with one of the components of a Velcro® type self-fixing fastening, for example the soft part 28 or astrakhan with a length ranging from 5 to 10 cm. The other end of the stretchy part 22 is attached to a strap 30 with a length ranging from 5 to 10 cm, getting out of the sleeve 24 through a loop 32 that makes said end stiff. On the inner face of the strap 30 is located a rectangle 34, with a length of about 5 cm, that makes up the prickly part of the self-fixing fastening. As mentioned above, the belt waist can be adjusted by using this type of self-fixing fastening.

While a Velcro® type self-fixing fastening is the preferred one, any other means suitable to fasten the two belt ends together could obviously be used instead.

In order to avoid buckling of the sleeve 24 when the latter is made of a rigid material, another embodiment uses a terry-towelling that is stretchy or presents, at least, some elasticity. This can be done by using a jersey, and especially the non-flammable and heat-resistant M1 standard compliant Kivel® fabric.

Other changes could be made to the belt without leaving the scope of the invention. This way, the absorption features could be improved by adding to the belt an absorbent and spreading material such as activated charcoal.

What is claimed is:

1. Trousers belt for use by a cook working close to heat sources, comprising:

a stretchy part having a first end and a second end, said stretchy part being inserted into a sleeve-shaped part made of a sweat absorbing material capable of absorbing the cook's sweat for several hours, and surrounding said stretchy part;

a self-fixing fastening for adjusting the belt waist, and comprising a first component made of one of a hook part or loop part located on the outer face of one belt end and a corresponding second component made of an opposite loop part or hook part located on the inner face of the other belt end;

said stretchy part being attached to said sleeve-shaped part only at an attachment area at the first end of said stretchy part, whereby said stretchy part is free to move within an entire length of said sleeve-shaped part except at said first end;

said attachment area being at a portion of said sleeve-shaped part on which is attached the first component of said self-fixing fastening; and the second component of said self-fixing fastening being attached to an inner face of a strap interdependent with the second end of said stretchy part located outside said sleeve-shaped part.

2. The belt according to claim 1, wherein said stretchy part is made of an elastomeric material.

3. The belt according to claim 2, wherein the elastomeric material is rubber.

4. The belt according to claim 1, wherein said sleeve-shaped part is made of a jersey absorbent fabric.

5. The belt according to claim 1, further comprising an absorbent and spreading material incorporated in said belt.

6. The belt according to claim 5, wherein the absorbent and spreading material is activated carbon.

* * * * *